United States Patent [19]

Bucher

[11] Patent Number: 4,660,548

[45] Date of Patent: Apr. 28, 1987

[54] MASSAGE APPARATUS

[75] Inventor: Heinz Bucher, Rothweil, Fed. Rep. of Germany

[73] Assignee: Metronic Electronic GmbH, Fed. Rep. of Germany

[21] Appl. No.: 728,830

[22] Filed: Apr. 30, 1985

[30] Foreign Application Priority Data

May 5, 1984 [DE] Fed. Rep. of Germany ..... 3416641

[51] Int. Cl.[4] ..... A61H 1/00

[52] U.S. Cl. ..... 128/33; 128/52; 272/96

[58] Field of Search ..... 128/24.2, 24 R, 24 A, 128/25 B, 28, 32–40, 45, 46, 47, 50–53, 56, 57, 59, 61, 62, 65, 66, 67, 49; 272/96; 15/28, 29

[56] References Cited

U.S. PATENT DOCUMENTS

| | | | |
|---|---|---|---|
| 917,367 | 4/1909 | Scott | 128/57 |
| 2,521,874 | 9/1950 | Runstedler | 128/57 |
| 2,553,873 | 5/1951 | Schwebel | 128/36 |
| 2,589,322 | 3/1952 | Archer | 128/36 |
| 2,638,089 | 5/1953 | Murphy | 128/57 |
| 2,951,479 | 9/1960 | Sellner | 128/33 |
| 3,043,293 | 7/1962 | Rider | 128/33 |
| 3,071,132 | 1/1963 | Lucht | 128/33 |
| 3,744,483 | 7/1973 | Picolin | 128/67 |
| 3,872,526 | 3/1975 | Betts | 128/33 |
| 4,030,487 | 6/1977 | McEachvan | 128/25 B |
| 4,446,855 | 5/1984 | Friedson | 128/25 B |

FOREIGN PATENT DOCUMENTS

| | | | |
|---|---|---|---|
| 144532 | 2/1936 | Austria | 128/57 |
| 2707604 | 8/1978 | Fed. Rep. of Germany | 272/96 |
| 2509172 | 1/1983 | France | 128/32 |

*Primary Examiner*—Clyde I. Coughenoun

*Attorney, Agent, or Firm*—Thomas W. Speckman

[57] ABSTRACT

A massage apparatus having a massage plate unit oscillated by electrical drive means, with the oscillatory motion being in the plane of a first component plate. The massage apparatus has a single drive unit and is suitable for administering vibratory as well as percussion massage. The massage plate has two component plates which form, with their upper surfaces, an angle of 270°. The first component plate is oscillated by motion components which act approximately perpendicular to the second component plate, and the second component plate undergoes rising and falling motions in accordance with such motion components.

20 Claims, 4 Drawing Figures

MASSAGE APPARATUS

BACKGROUND OF THE INVENTION

1. Field of the Invention

The present invention relates to a massage apparatus comprising a massage plate adapted to be oscillated by electrical drive means, wherein the oscillatory motion is directed in the plane of the massage plate.

2. Description of the Prior Art

A foot massager generally of the foregoing type has been disclosed in German Patent Publication No. OS 30 32 017 and in German Pat. No. PS 32 37 333. For dry massaging, the feet of the user are placed upon the oscillating plate to transfer vibrations from the plate to the feet. Thus, this particular type of massaging action is referred to as vibratory massage. By placing a water container upon the massage plate, the vibratory massage may be administered in the form of hydromassage.

Massaging devices in which periodic rising and falling motions are imparted to the massage plate are also known. This type of massaging action is frequently referred to as percussion massage. However, a massager of this particular kind requires an entirely different drive system for producing the up and down stroke motions of the massage plate.

SUMMARY OF THE INVENTION

It is an object of the present invention to produce a massaging device for vibratory massage. The massaging device is powered by a single drive unit and may be optionally used also for percussion massage.

This is accomplished according to the present invention in that the massage plate comprises two component plates, the inner surfaces of which form an angle of about 90°. The first component plate is adapted to be oscillated by components of motion in a direction approximately perpendicular to the second component plate, and the second component plate is caused to undergo rising and falling motions in accordance with such motion components.

In a massage plate unit according to this invention, the drive means imparts oscillatory motion to the first component plate, while the second component plate of the massage plate unit automatically undergoes the rising and falling motions required for percussion massage. The particular massaging action desired, either vibratory massage or percussion massage, is determined by the choice of use of one of the two component plates of the massage plate unit. The massaging apparatus maintains its constructional simplicity while at the same time, it covers a broader field of application, such as vibratory massage to the underside of the feet and percussion massage to the calves, to mention just a few. Use of the massaging apparatus in conjunction with a container placed upon the first component plate of the massage plate unit for underwater or hydromassage is possible. The coupling and decoupling arrangement between the drive unit and the impeller in the container according to German Pat. No. 32 37 333 may be utilized. Deviation from an angle of 90° formed by the component plates.of the massage plate unit, provided such deviation is small, will result in only a minor reduction in the length of the rising and falling strokes of the second component plate of the massage plate unit, because the motion components of the first component plate are no longer fully effective as they act on the up and down strokes of the second component plate.

One advantageous embodiment is characterized in that the upper sides of the component plates of the massage plate unit are provided with raised rounded protuberances of different sizes, with the protuberances on the second component plate being smaller than the protuberances on the first component plate.

According to another embodiment, the two component plates are joined by way of a convex rounded intermediate section to form a one-piece plate. The intermediate section may be provided with a series of undulations extending perpendicular to the motion components of the first component plate of the massage plate unit. The undulated intermediate section is preferably used for massaging the arch of the foot.

According to one embodiment, the massage plate drive is effective to impart oscillatory motion to the first component plate. Since the components of such oscillatory motion are perpendicular to the second component plate of the massage plate unit, the rising and falling strokes of the second component plate are effected by the full amplitude of the oscillations of the first component plate.

According to another embodiment, the vibratory massaging action is further enhanced, without adversely affecting the motion of the second component plate, in that the first component plate is caused to undergo circular or elliptical motions so that a vibratory massaging action is additionally imparted to the second component plate for percussion massage.

According to one embodiment, the construction of the massaging device is such that the massage plate is held between two angular side housings, and that the drive unit is mounted in a housing having a triangular cross section, the housing being disposed between the two side housings and the undersides of the component plates. The side housings project beyond the underside of the triangular housing and terminate in rounded supporting surfaces. Standing the massaging device on these supporting surfaces will afford a degree of inclination of the first component plate which is desired for foot massaging.

According to another embodiment, one side housing is wider than the other to accommodate the operating controls and indicating devices, preferably on the side of the component plate chosen for oscillation.

According to a further embodiment, the underside of the second component plate of the massage plate bears against resilient buffer means provided at the triangular housing and/or the side hqusings to brace the second component plate under load and protect it against excess load conditions.

According to another embodiment, the position of the component plates of the massage plate unit can be adjusted when the triangular housing is recessed between the side housings, and expandable legs are pivotably mounted between the triangular housing and the side housings. The supporting legs are pivotably mounted toward the end section of the housing for the second component plate. In their extended position, the legs are effective to maintain the second component plate in an approximately horizontal position, which is the desired position of the second component plate for administering percussion massage to the calves.

The safety of the massaging device may be further enhanced by a transverse bar connecting the free ends of the supporting legs.

BRIEF DESCRIPTION OF THE DRAWING

The invention will be described in further detail with reference to an embodiment illustrated in the drawings, in which.

DESCRIPTION OF PREFERRED EMBODIMENTS

Figure 1:
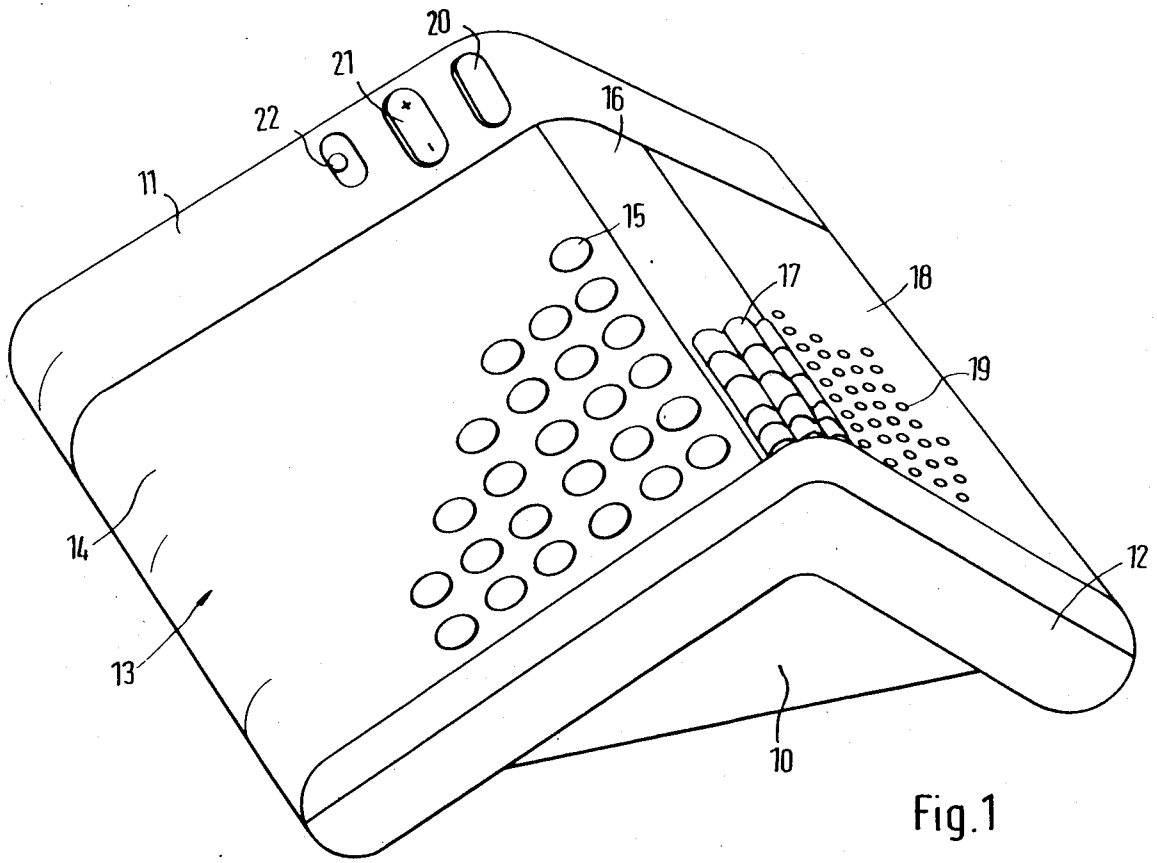
FIG. 1 is a perspective view of the massage apparatus comprising two component massage plates.

Referring to FIG. 1, the massaging device according to the invention has a roof-shaped configuration. The massage plate unit 13 comprises two component plates 14 and 18 disposed at an angle of about 90° with reference to each other and provided on their surfaces with rounded raised protuberances 15 and 19. Component plate 14 has protuberances 15 thereon and component plate 18 has protuberances 19, the latter being smaller than protuberances 15. Convex rounded intermediate section 16 is provided with undulations 17 and joins component plate 14 to component plate 18 to form the unitary massage plate unit 13. Undulations 17 are directed transverse to the direction of oscillatory motion of component plate 14. The oscillatory motion components 32 are directed in the plane of component plate 14 and are generated by an electric drive motor 31 operatively engaged with component plate 14 as shown schematically in FIG. 3.

Figure 4:
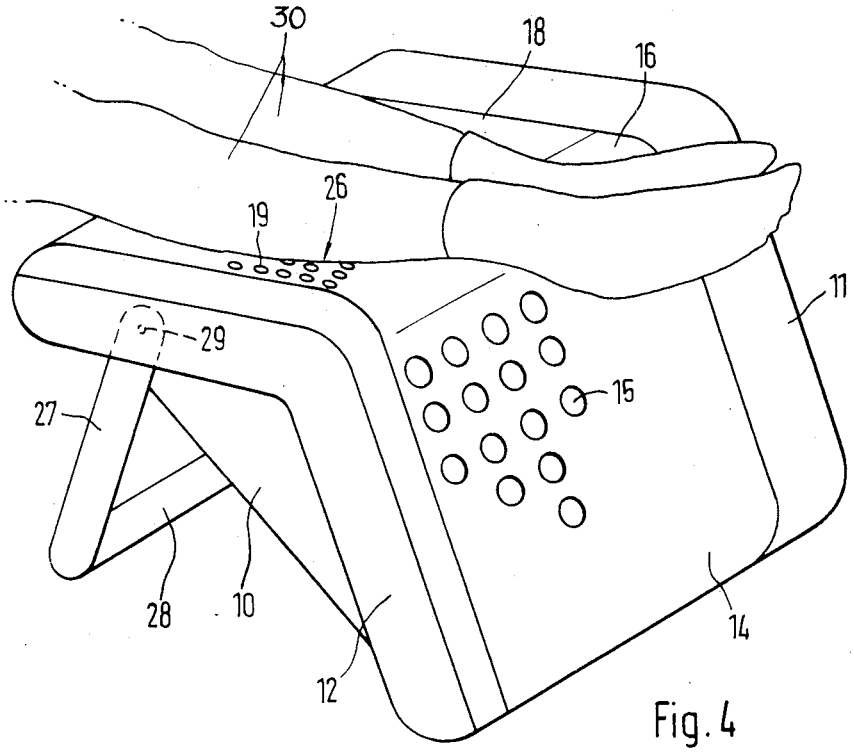
FIG. 4 is a perspective view of the massage apparatus as used for administering percussion massage to the calves.

Massage plate unit 13 is held between two side housings 11 and 12. Disposed in the wider housing in the area. of component plate 14 of massage plate unit 13 are controls 20 and 21 for operating the massage apparatus and for adjusting the vibratory motion, and indicating device 22. The drive unit is mounted in triangular housing 10 disposed on the undersides of-component plates 14 and 18 between the two side housings 11 and 12, enabling supporting legs 27 to be pivotably mounted between side-housings 11 and 12 and triangular housing 10, by means of pin 29, as shown in FIG. 4. The terminal ends of L-shaped side housings 11 and 12 are preferably rounded and project past the bottom portion of triangular housing 10 to provide supporting surfaces.

Figure 2:
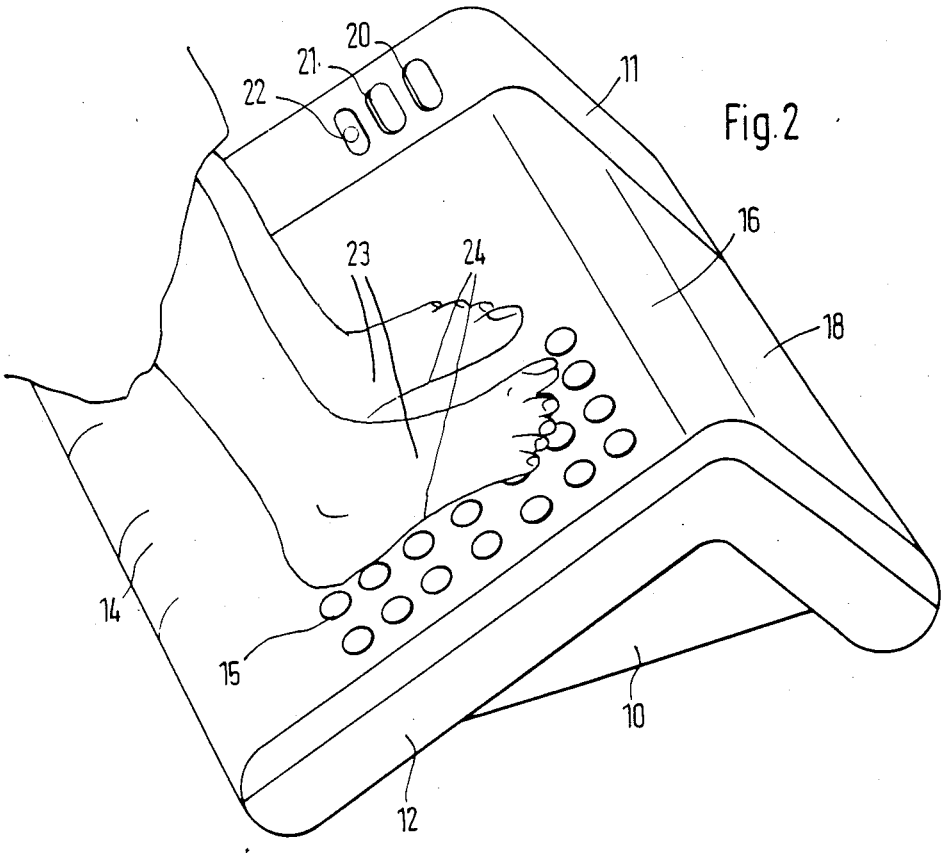
FIG. 2 illustrates the massage apparatus of FIG. 1 as used for vibratory massage applied to the soles of the user's feet.

When the massaging apparatus stands on the supporting surfaces of the L-shaped side housings 11 and 12, a person seated on a chair may comfortably place his or her feet 23 upon component plate 14 of massage plate unit 13 to receive vibratory massage on soles 24 of the feet, as shown in FIG. 2.

Figure 3:
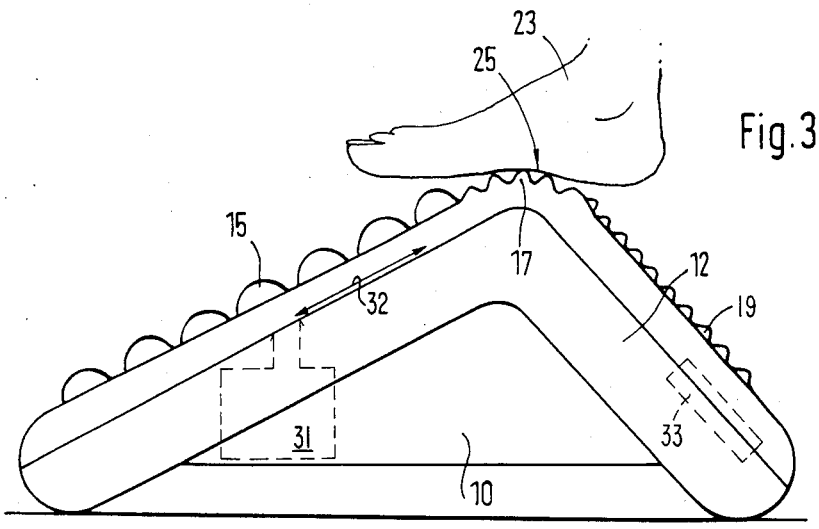
FIG. 3 is a side view of the massage apparatus as used for administering massage to the arches of the feet.

In the same position of the massaging device, feet 23 may be placed upon intermediate section 16 having undulations 17 to administer vibratory massage to the arches 25 of feet 23, as shown in FIG. 3. The vibrations of component plate 14 of massage plate unit 13 may also be in the form of circular or elliptical motions. It is important that motions of component plate 14 contain motion components 32 which are perpendicular to the plane of component plate 18 of massage plate unit 13 to enable component plate 18 to undergo appropriate rising and falling strokes. To afford sufficient clearance of the massage plate unit 13 in side housings 11 and 12, which clearance is required for adjustment purposes, buffer means 33 may be provided at side housings 11 and 12 and/or triangular housing 10 for contact by the underside of component plate 18, as shown schematically. Component plate 14 of massage plate unit 13 is coupled to the drive unit 31 in a conventional fashion.

Extending supporting legs 27 enable component plate 18 of massage plate unit 13 to assume an approximately horizontal position. Legs 30 may be placed upon the massager so that calves 26 rest on component plate 18 having protuberances 19 thereon. By virtue of the rising and falling motions of component plant 18 the calves of the user are subjected to a percussion massage. Supporting legs 27 of the massaging apparatus are strengthened at their end portions by transverse bar 28 to provide additional safety to the standing capacity of the massaging apparatus in the position shown in FIG. 4.

The embodiment illustrated and discussed in the foregoing is a massage apparatus specially intended for foot massage. However, the basic concept of disposing the two component plates of a massage plate unit at an angle to each other while providing a single drive for the unitary massage plate is applicable also to other massaging devices in order to optionally perform vibratory or percussion massage.

I claim:

1. Massage apparatus comprising a massage plate unit (13) driven by an electrical drive means generating motion components (32) directed in a single plane, wherein said massage plate unit (13) comprises a first and a second component plate (14, 18) provided on their outer surfaces with rounded raised protuberances (15,19), said component plates (14,18) forming with their inner surfaces an angle of about 90° with respect to each other and rigidly joined to each other by a convex rounded intermediate section (16), said first component plate (14) is operatively engaged with said drive means to move said first component plate (14) according to said motion components (32) directed in said single plane approximately parallel to the plane of said first component plate (14) and said second component plate (18) is caused to move due to said movement of said first component plate (14) according to said motion components (32) directed in said single plane approximately perpendicular to the plane of said second component plate (18), and said massage plate unit (13) is mounted between two side housings, (11,12) with a triangular housing (10) closing the space between said side housings and undersides of said component plates (14, 18), and said drive means operatively engaged with said first component plate (14) is mounted in said triangular housing (10), and adjustable support legs (27) are provided for positioning the component plates with respect to a support surface whereby said first component plate (14) provides an oscillatory massage due to said motion components (32) being directed substantially parallel to said first component plate (14), and said second component plate (18) simultaneously provides percussion massage due to said motion components (32) being directed substantially perependicular to said second component plate (18).

2. Massage apparatus according to claim 1, characterized in that said upper surfaces of said component plates (14,18) of said massage plate unit (13) are provided with protuberances (15, 19) of different size, said protuberances (19) of said second component plate (18) being smaller than said protuberances (15) of said first component plate (14).

3. Massage apparatus according to claim 2, characterized in that said component plates (14, 18) of said massage plate unit (13) are joined to each other by a convex rounded intermediate section (16), to form a one-piece massage plate.

4. Massage apparatus according to claim 3, characterized in that said intermediate section (16) comprises undulations, with the peaks of said undulations being divided by cutouts into a plurality of partial sections, and that said sectioned undulations are directed perpendicular to said motion components of said first component plate (14) of said massage plate unit (13).

5. Massage apparatus according to claim 4, characterized in that said first component plate (14) of said massage plate unit (13) is adapted to undergo circular or elliptical vibratory movements.

6. Massage apparatus according to claim 5, characterized in that said side housings (11, 12) extend beyond the underside of said triangular housing (10) and terminate in rounded supporting surfaces.

7. Massage apparatus according to claim 6, characterized in that one said side housing (11) is wider than the other and accommodates operating controls (20, 21) and an indicating element (22) in the area of said oscillatable first component plate (14) of said massage plate unit (13).

8. Massage apparatus according to claim 7, characterized in that the underside of said second component plate (18) of said massage plate unit (13) bears against resilient buffers (33) provided on at least one of said triangular housing (10) and said side housings (11, 12).

9. Massage apparatus according to claim 8, characterized in that said triangular housing (10) is recessed between said side housings (11, 12), and extendable supporting legs (27) are pivotably mounted between said triangular housing (10) and said side housings (11, 12).

10. Massage apparatus according to claim 9, characterized in that said supporting legs (27) are pivotably mounted in an end section of said second component plate (18) of said massage plate unit (13) and in the extended position maintain said second component plate (18) of said massage plate unit (13) in an approximately horizontal position.

11. Massage apparatus according to claim 10, characterized in that the free ends of said supporting legs (27) are connected by a transverse bar (28).

12. Massage apparatus according to claim 1, characterized in that said component plates (14, 18) of said massage plate unit (13) are joined to each other by a convex rounded intermediate section (16) to form a one-piece massage plate.

13. Massage apparatus according to claim 12, characterized in that said intermediate section (16) comprises undulations, with the peaks of said undulations being divided by cutouts into a plurality of partial sections, and that said sectioned undulations are directed perpendicular to said motion components of said first component plate (14) of said massage plate unit (13).

14. Massage apparatus according to claim 1, characterized in that said first component plate (14) of said massage plate unit (13) is adapted to undergo circular or elliptical vibratory movements.

15. Massage apparatus according to claim 1, characterized in that said side housings (11, 12) extend beyond the underside of said triangular housing (10) and terminate in rounded supporting surfaces.

16. Massage apparatus according to claim 15, characterized in that one said side housing (11) is wider than the other and accommodates operating controls (20, 21) and an indicating element (22) in the area of said oscillatable first component plate (14) of said massage plate unit (13).

17. Massage apparatus according to claim 1, characterized in that the underside of said second component plate (18) of said massage plate unit (13) bears against resilient buffers (33) provided on at least one of said triangular housing (10) and said side housings (11, 12).

18. Massage apparatus according to claim 1, characterized in that said triangular housing (10) is recessed between side housings (11, 12), and extendable supporting legs (27) are pivotably mounted between said triangular housing (10) and said side housings (11, 12).

19. Massage apparatus according to claim 18, characterized in that said supporting legs (27) are pivotably mounted in an end section of said second component plate (18) of said massage plate unit (13) and in the extended position maintain said second component plate (18) of said massage plate unit (13) in an approximately horizontal position.

20. Massage apparatus according to claim 18, characterized in that the free ends of said supporting legs (27) are connected by a transverse bar (28).

* * * * *